United States Patent [19]

Eisses

[11] 3,939,617

[45] Feb. 24, 1976

[54] METAL HOLDER FOR DISPOSING A GUIDE STRUCTURE ON A CONCRETE FOUNDATION

[76] Inventor: Jacob Albertus Eisses, Haydnlaan 4, Bilthoven, Netherlands

[22] Filed: July 2, 1974

[21] Appl. No.: 485,211

[30] Foreign Application Priority Data

July 10, 1973 Netherlands ..... 7309640

[52] U.S. Cl. ..... 52/166; 52/698; 238/107; 238/84

[51] Int. Cl.[2] ..... E02D 5/74

[58] Field of Search ..... 52/515, 517, 173, 295, 52/166; 238/106, 107, 315, 321, 349, 84, 85, 29, 263, 377

[56] References Cited

UNITED STATES PATENTS 2,779,543 1/1957 Grönlund ..... 238/107 X 3,067,947 12/1962 Deenik et al. ..... 238/349 X

*Primary Examiner*—Frank L. Abbott
*Assistant Examiner*—Carl D. Friedman
*Attorney, Agent, or Firm*—John P. Snyder

[57] ABSTRACT

A metal holder for disposing a guide structure on a concrete foundation, the holder having a top part in the form of an open housing which serves for lateral retention of the guide structure and in which fastening means can engage, the housing being provided with anchoring parts at the underside, wherein the housing is provided with a metal baseplate disposed in a plastic mortar panel which adjoins all round the housing by a horizontal top surface and which adjoins a layer of plastic mortar on the underside, said layer of plastic mortar completely surrounding the anchoring parts of the housing.

9 Claims, 5 Drawing Figures

METAL HOLDER FOR DISPOSING A GUIDE STRUCTURE ON A CONCRETE FOUNDATION

This invention relates to ametal holder for disposing a guide structure on a concrete foundation, the holder having a top part in the form of an open housing which serves for lateral retention of the guide structure and in which fastening means can engage, the housing being provided with anchoring parts at the underside. To obtain the required electrical insulation in relation to the concrete, holders of this kind are insulated from the concrete by a layer of plastic mortar. The holders were hitherto disposed in the concrete by leaving a recess open therein, such recess subsequently being filled with liquid plastic mortar. The holder is pressed into the plastic mortar before the plastic mortar has set. When it has set the holder is immovably located in the concrete by way of the plastic mortar. The disadvantage of this process is that first the concrete product must be made and then time is required until the concrete product sets sufficiently. In a second stage of the process, the concrete products then have to be provided with the holders. Consequently, a large number of concrete blocks have to be kept in stock, and this is a disadvantage in view of the available space. The object of the invention is to provide a holder which permits much simpler production.

According to the invention, the housing is provided with a metal baseplate disposed in a plastic mortar panel which adjoins all round the housing by a horizontal top surface and which adjoins a layer of plastic mortar on the underside, said layer of plastic mortar completely surrounding the anchoring parts of the housing. The holder can now be provided with a plastic mortar lining beforehand in the manner described. During concreting, the holder can be disposed in the jig, so that during the relatively long time required for the concrete to set the holder is also secured. Thus the holder is anchored in the concrete as soon as the concrete product is ready. Only the relatively small holders with the plastic lining now have to be kept in stock.

According to the invention, in a holder in which the anchoring parts of the housing are formed by two spaced feet, the layer of plastic mortar disposed on the inside of the feet leaves a narrower opening between the feet in the region of the ends than in the region of the housing. When the holder is concreted, a reinforcing bar may be disposed between the feet. Since the opening between the feet is narrower in the end zone, very good anchoring of the holder around the reinforcement is obtained.

According to the invention, the housing may have side surfaces which point towards one another from the baseplate. In this way it is possible to dispose the plastic mortar simply. The holder can then be disposed upside down in a mould, the housing projecting outwardly through an opening in the mould wall. The housing baseplate then adjoins the edges of the opening. Consequently, the housing is not covered with plastic. A core then must be disposed between the feet and is removed laterally after the holder has been removed from the mould.

The invention also relates to a method of securing the holders of the above-described kind in concrete blocks. According to the invention the concrete blocks are concreted in a mould in which one or more holders are disposed, which holders project outwardly with the housing through an opening in the formwork wall on which the top surface of the blocks is formed, the opening being sealed around the housing by the plastic mortar panel.

The invention is described in detail below with reference to an exemplified embodiment illustrated in the drawing wherein.

Figure 5:
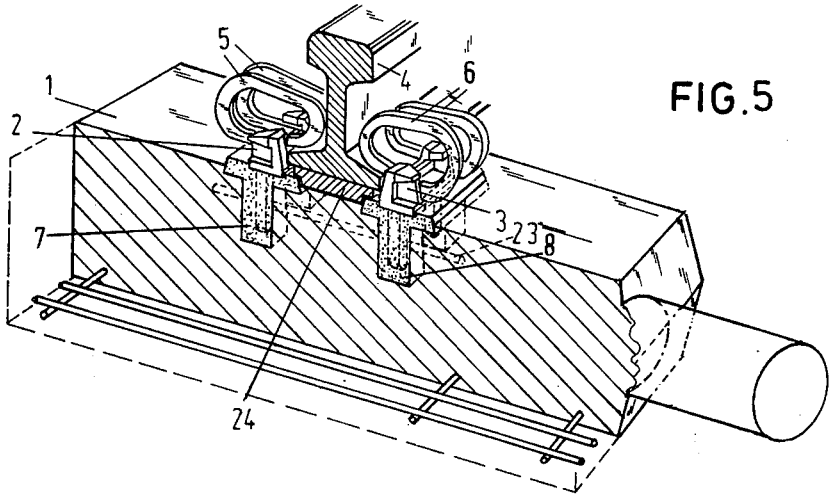
FIG. 5 is a diagrammatic perspective view of a concrete block with holders for fastening a railway rail, which is also shown.

Referring to FIG. 5, two metal holders 2 and 3 are secured in a concrete block 1 and their housing projecting beyond the concrete serves for lateral retention of a rail 4, which is also secured to the block 1 by means of elastic clamps 5 and 6 which engage by one end in the open side of the holders 2 and 3 and by the other end on the foot of the rail 4. The anchoring parts of the holders 2 and 3 project into layers of plastic mortar 7 and 8 which are disposed in the concrete of the block 1. The holder shown in FIG. 1 has an open housing 9 which is provided with a metal baseplate 10 which projects into the opening 11 of a baseplate 12 of a mould. Side parts 13 and 14 are provided on the baseplate 12, part 14 being shown next to the mould in FIG. 2 by a dotted line. The anchoring parts 15 of the holder project freely into the mould. The mould is filled with plastic mortar 16 from above. The shape of the baseplate 12 results in a plastic panel 17 which adjoins the housing of the holder 9 by a horizontal surface 18. The anchoring parts 15 are completely surrounded by the plastic mortar and the same applies to the housing baseplate. As will be seen in FIG. 2, the side parts 13 and 14 can be removed laterally, while the holder provided with plastic can be removed upwardly from the baseplate in view of the fact that the housing tapers away from the baseplate.

To dispose the holder in a concrete block 19, the holder is placed in a mould consisting of vertical formwork walls 20 and a horizontal formwork wall 21. The top surface of the concrete block is formed at the wall 21. The latter has an aperture 22 with an abutment surface for the horizontal surface 18 of the plastic mortar panel 17. The aperture 22 is closed as a result. The concrete for the block 19 is then introduced into the formwork and after the concrete has set the holder is disposed in the concrete block 19. The formwork walls can then be removed. Where the holders and concrete blocks are made in this way, all that has to be stocked is the holders provided with plastic, and the holders are also secured immediately after the blocks are made. They can therefore be taken away immediately. As will be seen from FIGS. 1 and 3, the opening between the anchoring parts 15 after the plastic has been put in position is smaller in the end zone than in the housing zone. The facing surfaces of the plastic layer of the anchoring parts thus point towards one another in the direction of the ends. A reinforcing rod 23 can extend between the anchoring parts 15 in the block. Since the facing surfaces of the plastic layer of the anchoring parts point towards one another in the direction of the ends, perfect anchoring of the holder around the reinforcement 23 is obtained. As can be seen from FIG. 5, the metal of the holders 2 and 3 cannot come into contact with the concrete anywhere. Very good electrical insulation is obtained as a result. The rail is placed on an insulating layer 24 so that the entire guide structure is insulated from the concrete.

Figure 4:
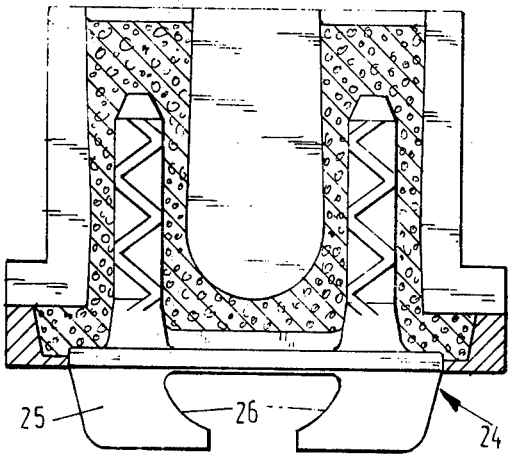
FIG. 4 is a mould corresponding to the mould shown in FIG. 1, but with a different construction of the metal holders.

In the embodiment of the metal holder 24 according to FIG. 4 the housing 25 has a continuous arcuate opening 26. The side of the limbs of the clamp guided in the opening 26 are preferably bevelled to ensure better abutment against the wall of the opening 26.

Figure 1:
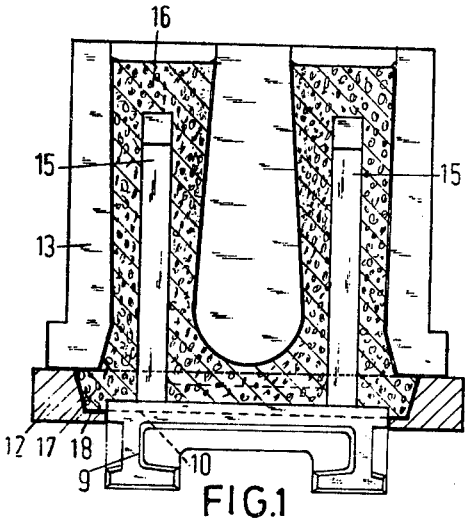
FIG. 1 shows a mould for casting a holder in plastic mortar with a finished product.
Figure 2:
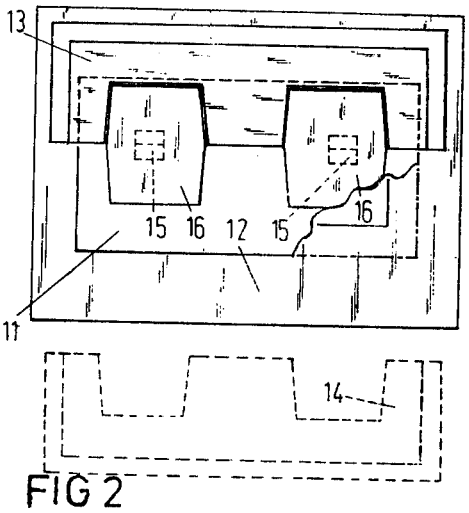
FIG. 2 is a plan view and partial section of the mould shown in FIG. 1.
Figure 3:
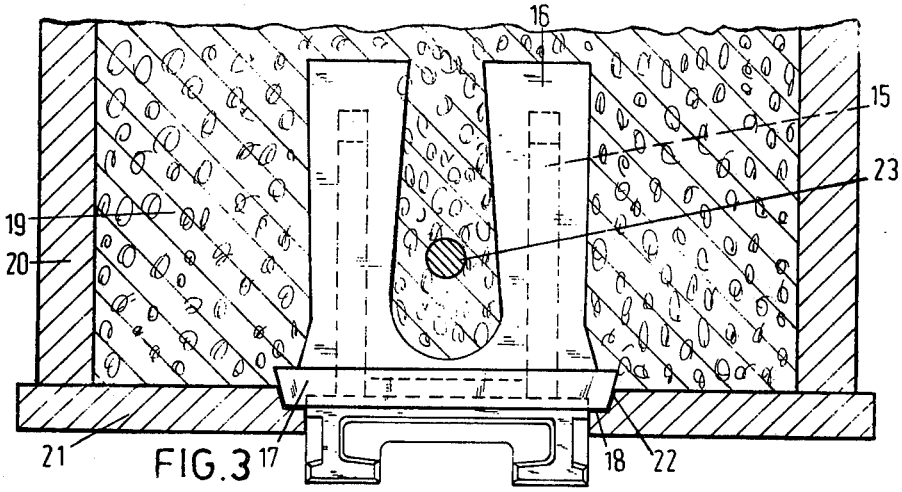
FIG. 3 is a section of a mould for concreting the holder according to the invention.

Otherwise the metal holder 24 is constructed in exactly the same way as the holder shown in FIGS. 1–3.

What I claim is:

1. A metal holder for disposing a guide structure on a concrete foundation, the holder having a top part in the form of an open housing which serves for lateral retention of the guide structure and in which fastening means can engage, the housing being provided with anchoring parts at the underside, characterised in that the housing is provided with a metal baseplate disposed in a plastic mortar panel which adjoins all round the housing by a horizontal top surface and which adjoins a layer of plastic mortar on the underside, said layer of plastic mortar completely surrounding the anchoring parts of the housing.

2. A metal holder according to claim 1, in which the anchoring parts of the housing are formed by two spaced feet, characterised in that the layer of plastic mortar disposed on the inside of the feet leaves a narrower opening between the feet in the region of the ends than in the region of the housing.

3. A metal holder according to claim 1, characterised in that the housing has side surfaces which point towards one another from the baseplate.

4. A rail anchoring assembly comprising, in combination:

a metal holder having a horizontal baseplate portion provided with anchoring means depending therefrom and surrmounted by a housing portion, the housing portion being adapted to receive fastening means for clamping a rail to a concrete tie; and electrical insulation means for insulating between said metal holder and a concrete tie, said insulation means being in the form of a mass of plastic mortar completely enclosing said anchoring means and surrounding a lower part of said baseplate portion adjacent said anchoring means, said insulating means presenting a horizontal top surface above which an upper part of said baseplate portion and the entirety of said housing portion project, said top surface completely surrounding said baseplate portion.

5. A rail anchoring assembly as defined in claim 4 wherein said anchoring means is in the form of spaced legs connected to and depending from said baseplate portion, said insulating means enclosing said legs to present a bifurcation which is narrower in a region remote from said baseplate portion.

6. A rail anchoring assembly as defined in claim 5 wherein said bifurcation narrows progressively.

7. A rail anchoring assembly as defined in claim 4 in combination with a concrete tie, said anchoring assembly being partially embedded in said tie such that said top surface projects above said tie.

8. A rail anchoring assembly as defined in claim 4 wherein that portion of said plastic mortar which surrounds said lower part of the baseplate portion presents vertically extending opposite side surfaces, and in combination with a concrete tie, said anchoring assembly being partically embedded within said tie such that at least portions of said opposite side surfaces are enclosed by said tie.

9. A rail anchoring assembly as defined in claim 8 wherein said opposite side surfaces are beveled to taper upwardly and inwardly.

* * * * *